US006837973B1

(12) United States Patent
Karner

(10) Patent No.: US 6,837,973 B1
(45) Date of Patent: Jan. 4, 2005

(54) APPARATUS FOR ELECTRICALLY COATING A HOT-ROLLED STEEL SUBSTRATE

(75) Inventor: Wilhelm Karner, Eichgraben (AT)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 695 days.

(21) Appl. No.: 09/363,038

(22) Filed: Jul. 29, 1999

(51) Int. Cl.[7] ..... C25D 7/06
(52) U.S. Cl. ..... 204/208; 204/206; 204/207
(58) Field of Search ..... 204/207, 208, 204/206

(56) References Cited

U.S. PATENT DOCUMENTS 3,755,090 A * 8/1973 Jackson et al. ..... 204/34
4,670,354 A * 6/1987 Polard et al. ..... 428/621
5,236,574 A * 8/1993 Oshima et al. ..... 205/138
5,766,438 A * 6/1998 Ishibashi et al. ..... 204/520

* cited by examiner

*Primary Examiner*—Nam Nguyen
(74) *Attorney, Agent, or Firm*—Roylance, Abrams, Berdo & Goodman, L.L.P.

(57) ABSTRACT

A process and apparatus are provided for producing an electrolytically coated, hot-rolled steel strip without any intervening strips. The apparatus includes a chemical pickling section being combined in one line with an electrolytic coating section containing electrolytic cells so that the pickled steel strip is fed directly to the electrolytic coating section without any intermediate steps. The spent electrolyte solution from the electrocoating section to the pickling section to pickle the steel. The spent pickling acid can also be used to generate the electrolyte solution that is fed to the electrocoating section.

10 Claims, 1 Drawing Sheet

APPARATUS FOR ELECTRICALLY COATING A HOT-ROLLED STEEL SUBSTRATE

FIELD OF THE INVENTION

The present invention is directed to a process and apparatus for electrolytically coating a hot rolled steel substrate. More particularly, the invention is directed to a continuous process and apparatus for pickling a hot rolled steel and electrolytically coating the steel without any intermediate process steps.

BACKGROUND OF THE INVENTION

In the manufacture of steel products, a coating is often applied to the finished product. The main objective is to protect the steel product against corrosion. Coatings containing zinc or zinc alloys cover by far the largest share of the market for this purpose. However, tin and chrome coatings also have significant share in the packing plate sector of the market.

In continuous processes for coating a steel strip, two processes in particular have attained major importance, namely, hot galvanizing and electrolytic galvanizing or electrolytic coating. Hot galvanizing, also referred to as the hot-dip process, immerses a steel substrate in a molten zinc bath where the zinc forms an alloy with the iron on the surface of the steel substrate. Electrolytic galvanizing places the steel substrate in an electrolyte bath containing zinc ions and applies an electric current to the bath to plate the zinc onto the steel substrate.

In both cases, a cold-rolled strip is the initial material used. The cold-rolled strip is formed from a hot-rolled strip having an initial thickness greater than the thickness of the desired product. Typically, the hot-rolled steel strip has a thickness of 1.5 to 5 mm. The hot-rolled steel strip is then cold-rolled to a final thickness of 0.3 to 2 mm.

Before the hot-rolled strip can be cold-rolled, the scale that has formed during hot-rolling must be removed. The scale from the hot-rolling process is a surface layer made up of different iron oxides with a typical thickness of about 5 to 20 $\mu$m. The scale is removed by decomposing the scale layer in mineral acids, such as sulfuric, hydrochloric acid and mixtures of various acids. This process is known as pickling and is implemented in batch-type or continuous pickling plants. One configuration of a pickling apparatus for this process is described, for example, in Austrian Patent No. AT 399,517.

Various efforts have been made to combine individual process stages in the production of steel strips in order to reduce operating costs for the plants and to improve the quality of the product. The current state of the art, for example, is to integrate the pickling and cold-rolling processes in a single building so that the hot rolled teel is fed directly to the cold rolling machinery. German Patent No. DE-PS 1 960 6305 C1 assigned to Mannesmann, on the other hand, describes an apparatus for carrying out the hot-rolling and pickling processes in one plant.

The steel hardens during the cold-rolling processes for forming a steel strip. The hardening of the steel must be reversed in a subsequent annealing process before the steel can be used. This annealing process is usually conducted in a batch operation in a hood-type furnace or in a continuous process in a continuous, through-type furnace. In hot galvanizing, the annealing and coating processes are combined in a single strip treatment plant, where the annealing process takes place first and the strip is then covered with a layer of zinc in a further stage by being dipped into a molten zinc bath.

Another process of depositing zinc and other metals on a steel strip is the electrolytic process. In this case, the strip, which is usually an annealed, cold-rolled strip, is pulled through an electrolyte bath containing dissolved metal ions. The strip is connected to the negative pole of a rectifier (the cathode) by a suitable connection, while metallic anodes connected to the positive pole of the rectifier are mounted opposite the strip. By applying an electric current between these poles, the metal ions are deposited on the steel strip in metallic form.

An electrolytic process of this type is described, for example, in Austrian Patent No. AT 373,922. A different process, which is particularly suitable for depositing zinc alloys from chloride electrodes because the anode area is separated from the cathode area by a diaphragm, is described in EP 580 730 (SIKEL).

Over the past few years, the production process for producing a hot-rolled steel strip has seen significant development and it has become possible to produce a thin strip directly by a hot-rolling process that could previously be obtained only by cold-rolling processes. As a result, this hot-rolled strip can be used in many applications which were previously reserved for a cold-rolled strip. In these processes, the corrosion protection layer must be applied to the hot-rolled strip. Japanese Patent No. JP 91258210, therefore, suggests de-scaling hot-rolled strip in a dry process and then feeding the cleaned steel strip to a hot-galvanizing process. This process, however, has some disadvantages because dry de-scaling processes are expensive. In addition, there is no longer an advantage in combining the annealing and hot-galvanizing processes, which is an advantage for cold-rolled strips, because there is no need to anneal the hot-rolled strip.

Accordingly, there is a continuing need in the industry for an improved process of coating a hot-rolled steel sheet.

SUMMARY OF THE INVENTION

The present invention is directed to a process and apparatus for electroplating a hot-rolled steel substrate. More particularly, the invention is directed to a continuous process for carrying a hot-rolled steel strip through a pickling bath and then coating the steel strip in an electroplating bath.

Accordingly, a primary object of the invention is to provide a process and apparatus for continuously feeding a hot-rolled steel strip through a pickling bath, and then immediately feeding the hot-rolled steel strip to a coating bath for electrolytically coating the steel strip.

Another object of the invention is to provide a process and apparatus for continuously feeding a hot-rolled steel strip to a pickling bath, and then immediately to an electroplating bath without any intermediate processing steps.

Another object of the invention is to provide a process and apparatus for feeding a hot-rolled steel strip through a pickling bath, rinsing the pickled steel strip and then feeding the steel strip to an electroplating bath.

A further object of the invention is to provide a process and apparatus for pickling a hot-rolled steel strip in a hydrochloric acid bath, and thereafter electroplating the pickled steel strip in a metal chloride bath.

Another object of the invention is to provide a process for feeding a hot-rolled steel strip to a sulfuric pickling bath, and thereafter feeding the pickled steel strip to a metal sulfate electrolyte solution for electroplating the steel strip.

Another object of the invention is to provide a continuous process for pickling and electroplating a hot-rolled steel strip where the spent pickling acid is used in an electroplating electrolyte solution.

Another object of the invention is to provide a method and apparatus for continuously pickling and electroplating a hot-rolled steel strip where the spent electrolyte solution from the electroplating bath is used as the pickling acid in the pickling process.

Another object of the invention is to provide a method and apparatus for pickling a hot-rolled steel strip and electroplating the pickled hot-rolled steel strip at a temperature of at least 40° C., and preferably about 50–90° C.

The objects and advantages of the invention are basically attained by providing a process for producing an electroplated steel substrate comprising the steps of feeding a hot-rolled steel substrate through a pickling bath and pickling the steel substrate to remove scale on the surface thereof and produce a pickled steel substrate, and feeding the pickled steel substrate directly to an electrolyte solution bath and applying an electric current to the bath to electroplate the pickled steel substrate.

The objects and advantages of the invention are further attained by providing an apparatus for producing an electrically coated hot-rolled steel substrate where the apparatus comprises a pickling tank having a feed device for feeding a hot-rolled steel substrate into the pickling tank for pickling the steel substrate and discharging the pickled steel substrate. The apparatus further includes an electro-coating tank positioned to receive the pickled steel substrate directly from the pickling tank where the electro-coating tank contains an electrolyte solution and electrodes for producing an electric current in the solution to electroplate the pickled steel substrate.

The objects, advantages and salient features of the invention will become apparent form the following detailed description, which in conjunction with the annexed drawings, disclose preferred embodiments of the invention.

BRIEF DESCRIPTION OF THE DRAWINGS

The following is a brief description of the drawing which discloses one embodiment of the invention, in which.

DETAILED DESCRIPTION OF THE INVENTION

Figure 1:
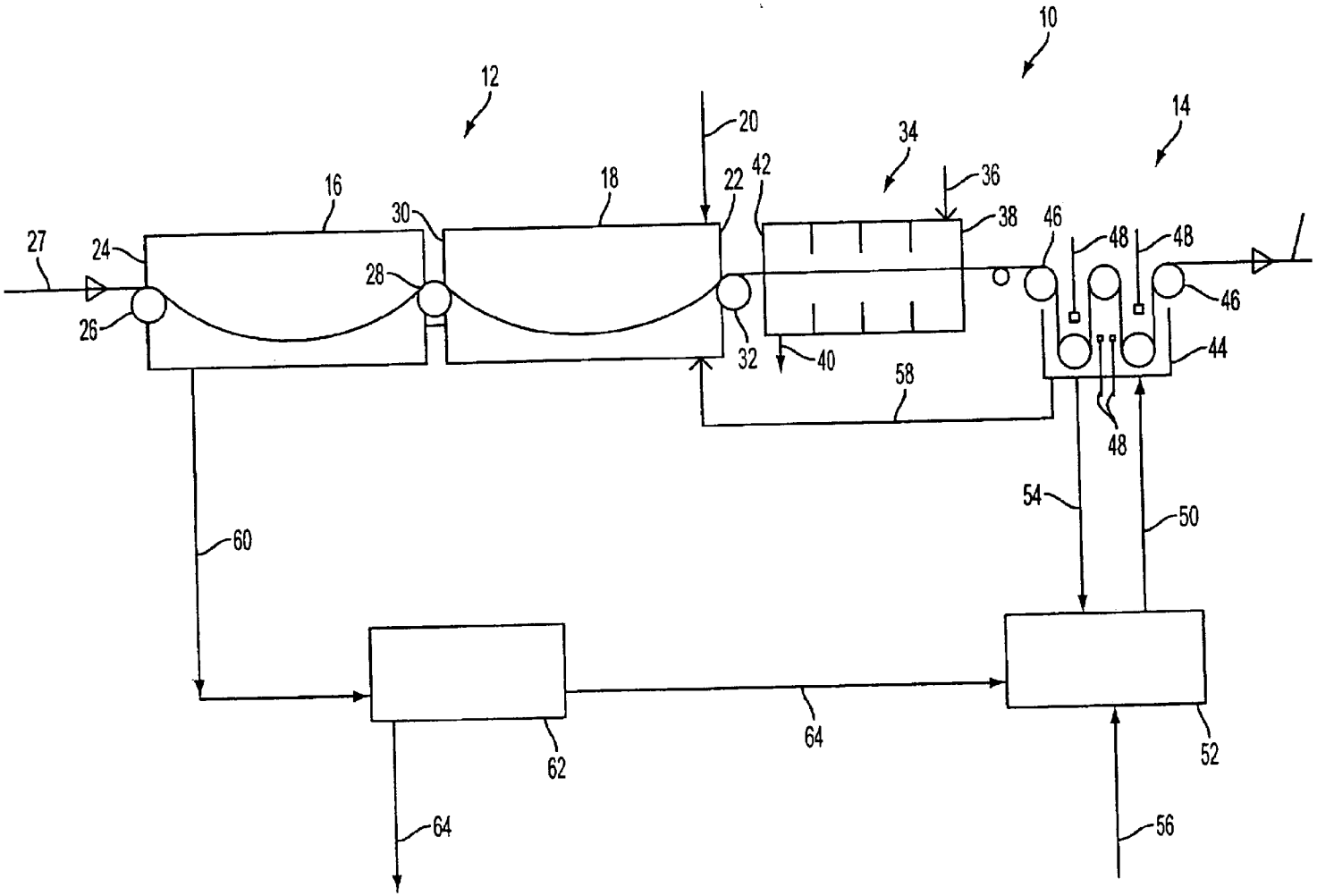
FIG. 1 is a schematic view of a pickling bath and electroplating bath in a preferred embodiment of the invention.

The present invention is directed to a process and apparatus for electrolytically coating a hot-rolled steel substrate. The process and apparatus of the invention basically comprise a chemical pickling tank connected in series to an electroplating tank whereby the pickled hot-rolled steel is carried directly to the electroplating tank substantially without intervening steps.

An advantage of the present invention is that the pickling bath and the electroplating bath can be operated at relatively low temperatures of about 50° C. to about 90° C. in aqueous solutions. In addition, by electroplating the steel strip immediately after the pickling process, the overall process can be carried out efficiently and economically. The prior processes use a cold-rolled steel which must be annealed to a temperature of about 300–500° C. The annealed strip of steel is then coated with an oil to reduce corrosion and stored until ready for use. The oiled steel strip must then be cleaned before use and pickled before the cold-rolled steel can be electroplated. The present invention eliminates the annealing step and the cleaning step since the steel strip is electroplated immediately after the pickling step. The process of the invention results in reduced chemical consumption and reduces the amount effluent produced by the pickling and electroplating processes.

Referring to FIG. 1, the apparatus 10 includes a pickling section 12 and an electro-coating section 14. In the embodiment illustrated, the pickling section 12 includes two pickling tanks 16 and 18 connected in series. The pickling tanks 16 and 18 can be a conventional continuous feed type tank as known in the art. Although two pickling tanks are shown, additional tanks can be used in series as needed. Fresh pickling acid is supplied through a pipe 20 into the downstream pickling tank 18 adjacent the outlet end 22. The pickling acid flows through the pickling tank 18 and overflows into the pickling tank 16 either by a pump or through a weir. The upstream pickling tank 16 includes an inlet end 24 having a feed roller 26 for continuously feeding a strip of steel 27 through the pickling tank. A second feed roller 28 directs the steel strip 27 from the pickling tank 16 into the inlet end 30 of the pickling tank 18. A discharge roller 32 is positioned at the discharge end 22 of the pickling tank 18 for directing the pickled steel strip downstream.

The pickling acid is typically a concentrated mineral acid such as sulfuric acid, hydrochloric acid and mixtures of acids. The pickling acid solution generally has a pH of about 2.0 and typically about pH 1.0 or less as known in the art.

An optional rinsing stage 34 is shown immediately downstream of the discharge roller 32 of the pickling tank 18 for rinsing residual pickling liquid from the treated steel strip. The rinsing tank 34 can be a conventional rinsing tank as known in the art. Fresh water is supplied through a pipe 36 adjacent the discharge end 38 of the rinse tank 34 to rinse the steel strip. The rinse water can be discharged through an outlet pipe 40 shown adjacent the inlet end 42 of the rinse tank 34. The rinse water can be recovered and recycled using standard procedures.

The electrolytic coating section 14 is positioned immediately downstream of the rinse tank 34 in the embodiment illustrated. In further embodiments, the electrolytic coating section 14 is positioned immediately downstream of the pickling tank 18 to receive the pickled steel directly from the pickling bath without any intermediate steps. The electrolytic coating section 14 includes an electro-coating tank 44. The electro-coating tank 44 can be a conventional electro-coating or electroplating system as known in the art. In the embodiment illustrated, the electro-coating tank 44 includes a plurality of feed rollers 46 for directing the strip of steel through the electrolyte solution in a generally serpentine path to attain the desired immersion time in the electrolyte solution. Several anodes 48 are positioned in the electrolyte solution within the tank 44 and are connected to a suitable power source for producing an electric current as known in the art. The steel strip is also connected to the power source so that the steel strip acts as the cathode for the electrolytic process. An electrolyte solution is supplied through a pipe 50 from a tank 52. The spent electrolyte solution is returned to the tank 52 through a pipe 54. In preferred embodiments, tank 52 is a dissolving tank or column for dissolving the coating metal or metal compound used to form the electrolyte solution. Typically, the electrolyte solution is a zinc, nickel or zinc alloy electrolyte solution such as zinc chloride, nickel chloride, zinc sulfate or nickel sulfate solution. Zinc, zinc oxide, or nickel carbonate can be supplied to the tank 52 through an inlet 56 which dissolves in the acid as known in the art. Alternatively, an electrolyte solution containing zinc ions can be supplied to the tank 52 to replenish the zinc consumed during the electroplating process.

In embodiments of the invention, a portion of the spent electrolyte solution from the tank 44 is directed through a pipe 58 directly to the pickling bath tank 18 for pickling the steel strip. In embodiments, where the electrolyte solution is an acid solution, such as a sulfuric or hydrochloric acid, it has been found that the spent electrolyte solution is suitable for the pickling process step for pickling the hot-rolled steel strip in the pickling section 12.

The spent pickling acid solution is withdrawn from the inlet end 24 of the pickling tank 16 and carried through a pipe 60 to an acid cleaning device 62. The acid cleaning device 62 is a conventional cleaning device as known in the art for removing the impurities and iron salts produced during the pickling process and regenerating the pickling acid. A portion of the waste pickle liquor is discharged through an outlet pipe 64 which can be directed to an acid regenerating unit and returned to the pickling section 12 as fresh, regenerated acid. A portion of the spent pickling acid containing iron sulfates or iron chlorides produced during the pickling process is supplied to the tank 52 through a pipe 64 for dissolving the metal or compound used to form the electrolyte solution in the electroplating section 14. In this manner, the process can be essentially a continuous process where the acid solution is recirculated through the pickling tank to the electrolyte generating tank and the electrolytic coating tank and returned to the pickling tank 18. Preferably the same acid is used in the pickling tanks 16 and 18 as in the electroplating tank 44. For example, the pickling acid can be hydrochloric acid and the electrolyte solution for the plating tank can be zinc chloride or nickel chloride.

The following examples disclose various embodiments of the invention. In each of the following examples, a hot-rolled steel strip was fed to a pilot plant substantially as shown in FIG. 1 containing a decoiler, a degreasing unit, a pickling plant, galvanic cells, a rinsing section, a drier, and a recoiler. In each of the examples, the steel strip was a thin, descaled, hot-rolled steel strip, having a width of 300 mm and a thickness of 1 mm. The degreasing unit of the pilot plant was not used in these examples.

EXAMPLE 1

A sulfuric acid pickling solution containing 20% sulfuric acid at a temperature of 90° C. was supplied to the pickling tanks. A hot-rolled steel strip was fed to the inlet end of the pickling tank and carried through the sulfuric acid pickling solution and discharged through the outlet end of the pickling tank. The steel strip was rinsed briefly with water to remove residual pickling acid and iron sulfate on the steel strip. The steel strip was then carried directly to the electro-coating tank. Galvanic cells in the electro-coating tank were positioned in a vertical orientation and equipped with insoluble titanium anodes coated with iridium dioxide ($IRO_2$). The cells contained a zinc sulfate electrolyte solution with a pH of 1.5 and a temperature of 55° C. Four anodes were positioned in the galvanic cells, with two anodes positioned on the upper and lower side of the steel strip. The anodes were supplied with a current of 300 amps. The steel strip was fed through the electro-coatings tank at a speed of 30 meters per minute which produced a zinc layer of approximately 2 microns on the steel strip. The coated steel strip was discharged from the electro-coating tank and rinsed with water and then dried. The process yielded a product having a uniform silvery and shiny surface. Subsequent test using this process showed the zinc layer to adhere well to the surface of the steel.

EXAMPLE 2

A hydrochloric acid pickling solution containing 16% hydrochloric acid at a temperature of 80° C. was supplied to the pickling tank. The hot-rolled steel strip was passed through the pickling tank and supplied directly to the electrolytic coating tank without prior rinsing. The galvanic cells in the electro-coating tank were fitted with soluble zinc anodes in the form of strips. The electrolyte solution was a zinc chloride solution with a pH of 3.0 and a soluble iron content of approximately 5 grams per liter. An electric current was supplied to the anodes and the steel strip to form a layer of pure zinc on the steel strip. The coating was analyzed as being substantially pure zinc which produced a bright finish. The surface produced in this example was brighter than the zinc coating produced from the zinc sulfate electrolyte solution of Example 1. The resulting coating was assessed as adhering very well to the steel strip. Metallographic investigations also showed that the pickling process was complete with no residual scaling being detected.

EXAMPLE 3

In this example, a hydrochloric acid pickling solution containing 16% concentration hydrochloric acid and a temperature of 80° C. was supplied to the pickling tank. The hot-rolled steel strip was directed through the pickling acid and supplied directly to the electro-coating tank. The spent pickling acid was withdrawn from the pickling tank and pumped to a dissolving column containing granulated zinc. The spent pickling acid withdrawn from the pickling tank contained 100 grams per liter iron, 60 grams per liter HCl and total chlorides of 190 grams per liter. The spent pickling acid effectively consumed the granulated zinc and provided an electrolyte solution containing 100 grams per liter iron, 54 grams per liter zinc and total chlorides of 190 grams per liter. This electrolyte solution was then carried to the electro-coating tank. The electro-coating tank was fitted with insoluble anodes and a diaphragm. An electric current was supplied to the anodes and the steel strip to form a layer of zinc and iron on the steel strip. Analysis of the soluble iron content of the coating showed iron levels between 11% and 13%. In subsequent tests, the spent electrolyte solution from the electro-coating tank was fed to the pickling tanks. The spent electrolyte solution was shown to be effective in the pickling process of removing scale from the steel strip.

While various embodiments have been selected to illustrate the invention, it will be understood to those skilled in the art that various changes and modifications can be made to the process and the apparatus disclosed herein without departing from the spirit and scope of the invention as defined in the appended claims.

What is claimed is:

1. An apparatus for producing an electrolytically coated hot-rolled steel substrate, said apparatus comprising:

a pickling tank having a feed device for feeding a hot-rolled steel substrate into said pickling tank for pickling said steel substrate, and a discharge device for discharging a pickled steel substrate;

an electro-coating tank positioned immediately downstream of said pickling tank to receive said pickled steel substrate directly from said pickling tank substantially without any intermediate processing stages between said pickling tank and said electro-coating tank, said electro-coating tank containing an electrolyte solution and electrodes for producing an electric current in the solution to electro-coat said pickled steel substrate, and a conduit from said electrocoating tank to said pickling tank for directing spent electrolyte solution to said pickling tank.

2. The apparatus according to claim 1, wherein said feed device is a continuous feed device to feed a continuous steel strip through said pickling tank and said electro-coating tank includes a feed device for feeding a continuous steel strip through said electro-coating tank.

3. The apparatus according to claim 1, further comprising a rinse tank positioned to receive said pickled steel substrate directly from said pickling tank for rinsing pickling acid from said pickled steel substrate, and wherein said electro-coating tank is positioned immediately downstream of said rinse tank to receive said pickled steel substrate directly from said rinse tank.

4. The apparatus of claim 1, wherein said pickling tank contains a pickling acid.

5. The apparatus of claim 4, wherein said electro-coating tank contains an electrolyte solution and at least one anode for directing an electric current between said substrate and said anode.

6. An apparatus for producing an electrolytically coated hot-rolled steel substrate, said apparatus comprising:

a pickling tank having a feed device for feeding a hot-rolled steel substrate into said pickling tank for pickling said steel substrate, and a discharge device for discharging a pickled steel substrate;

an electro-coating tank positioned immediately downstream of said pickling tank to receive said pickled steel substrate directly from said pickling tank substantially without any intermediate processing stages between said pickling tank and said electro-coating tank, said electro-coating tank containing an electrolyte solution and electrodes for producing an electric current in the solution to electro-coat said pickled steel substrate; and a conduit for feeding a spent pickling acid from said pickling tank to a metal dissolving tank for dissolving a metal compound, and producing an electrolyte solution and a conduit from said metal dissolving tank to said electro-coating tank for feeding said electrolyte solution to said electro-coating tank.

7. An apparatus for producing an electrolytically coated hot-rolled steel substrate, said apparatus comprising:

a pickling tank containing pickling acid and having a feed device for feeding a hot-rolled steel substrate into said pickling tank for pickling said steel substrate, and a discharge device for discharging a pickled steel substrate from said pickling tank; and an electro-coating tank positioned to receive said pickled steel substrate directly from said pickling tank, said electro-coating tank containing an electrolyte acid solution containing a coating metal and electrodes for producing an electric current in the solution to electro-coat said pickled steel substrate;

a metal dissolving tank for dissolving said coating metal in said pickling acid;

a first conduit extending between said pickling tank and said metal dissolving tank for feeding a spent pickling acid from said pickling tank to a metal dissolving tank for dissolving a metal compound in said spent pickling acid, and producing an electrolyte acid solution containing said coating metal; and a second conduit extending between said metal dissolving tank to said electro-coating tank for feeding said electrolyte acid solution to said electro-coating tank.

8. The apparatus of claim 7, further comprising a third conduit extending between said electro-coating tank and said pickling tank for directing spent electrolyte solution from said electro-coating tank to said pickling tank.

9. An apparatus for pickling and electrolytically coating a hot-rolled steel substrate, said apparatus comprising:

a pickling tank containing a hot-rolled steel substrate and a pickling acid and having a feed device for feeding said hot-rolled steel substrate into said pickling tank for pickling said steel substrate, and a discharge device for discharging a pickled steel substrate; and an electro-coating tank positioned immediately downstream of said pickling tank and positioned for receiving said pickled steel substrate directly from said pickling tank, said electro-coating tank containing an acid electrolyte solution containing a dissolved coating metal and electrodes for producing an electric current in said acid electrolyte solution to electro-coat said pickled steel substrate, said electro-coating tank being coupled to said pickling tank to direct spent acid electrolyte solution to said pickling tank;

a metal dissolving tank for dissolving a coating metal into said electrolyte solution, said metal dissolving tank being coupled to said pickling tank for receiving spent pickling acid from said pickling tank and dissolving said coating metal into said spent pickling acid and producing regenerated acid electrolyte solution containing said dissolved coating metal, said metal dissolving tank being coupled to said electro-coating tank for supplying said regenerated acid electrolyte solution to said electro-coating tank.

10. The apparatus of claim 9, comprising a first conduit extending between said pickling tank and said metal dissolving tank, a second conduit extending between said metal dissolving tank and a third conduit extending between said electro-coating tank and said pickling tank.

* * * * *